US011059653B2

(12) United States Patent
Ben Ezri

(10) Patent No.: US 11,059,653 B2
(45) Date of Patent: Jul. 13, 2021

(54) INSULATING CUP

(71) Applicant: IMEX Vision LLC, Lake Forest, CA (US)

(72) Inventor: Natan Ben Ezri, Irvine, CA (US)

(73) Assignee: IMEX Vision, LLC, Lake Forest, CA (US)

( * ) Notice: Subject to any disclaimer, the term of this patent is extended or adjusted under 35 U.S.C. 154(b) by 314 days.

(21) Appl. No.: 15/485,573

(22) Filed: Apr. 12, 2017

(65) Prior Publication Data

US 2017/0295969 A1 Oct. 19, 2017

Related U.S. Application Data

(60) Provisional application No. 62/322,147, filed on Apr. 13, 2016.

(51) Int. Cl.
*B65D 81/38* (2006.01)
*A47G 19/22* (2006.01)
*B65D 3/06* (2006.01)

(52) U.S. Cl.
CPC ..... *B65D 81/3869* (2013.01); *A47G 19/2288* (2013.01); *B65D 3/06* (2013.01)

(58) Field of Classification Search
CPC ..... B65D 81/3869; B65D 81/3865; B65D 81/38; B65D 81/027; B65D 81/3841; B65D 81/3853; B65D 81/3881; B65D 3/06; B65D 3/22; A47G 19/2288; A47G 19/23
USPC ..... 220/592.17, 592.27, 592.16, 739; 229/403, 400
See application file for complete search history.

(56) References Cited

U.S. PATENT DOCUMENTS

2006/0118608 A1* 6/2006 Stahlecker ..... B31F 1/0038 229/403
2008/0087715 A1* 4/2008 Robertson ..... B65D 81/3874 229/403
2009/0230178 A1* 9/2009 Stahlecker ..... B65D 81/3869 229/403
2011/0240726 A1* 10/2011 Stahlecker ..... B65D 21/0233 229/199
2012/0125989 A1* 5/2012 Lin ..... B65D 81/3869 229/403
2012/0261427 A1* 10/2012 Bates ..... B65D 81/3869 220/592.17
2013/0306630 A1* 11/2013 Babinsky ..... B65D 81/3869 220/62.12

* cited by examiner

*Primary Examiner* — Robert Poon
(74) *Attorney, Agent, or Firm* — Rimas Lukas

(57) ABSTRACT

An insulating cup includes an outer body surrounding at least a portion of an inner body. The outer body folds inwardly and upwardly at the bottom end to form a distal fold that spaces the inner surface of the outer body at the bottom end away from the outer surface of the inner body. The outer body further includes an embossment across the majority of the length and width of the sidewall such that the inner surface of the outer body projects outwardly away from the inner body to space apart the inner surface of the outer body from the outer surface of the inner body in the location of the embossment. The distal fold and embossment separate the inner body and the outer body creating an insulating air space between substantially the entire inner surface of the outer body and the outer surface of the inner body.

17 Claims, 9 Drawing Sheets

INSULATING CUP

CROSS-REFERENCE TO RELATED APPLICATIONS

This application claims priority to and benefit of U.S. Provisional Patent Application Ser. No. 62/322,147 entitled "Insulating cup" filed on Apr. 13, 2016 which is incorporated herein by reference in its entirety.

FIELD OF THE INVENTION

This application relates generally to packaging, and in particular, to an insulated disposable cup for serving beverages such as water and coffee.

BACKGROUND OF THE INVENTION

Disposable beverage containers such as paper cups for handling hot or cold temperatures require enhanced performance characteristics including but not limited to insulating the beverage to prevent it from cooling down if a hot beverage is contained or heating up if a cold beverage is contained. Typically, paper cups with hot liquids are difficult to handle by hand and can cause accidents and spills when they are too hot to handle. Paper cups containing cold liquids when held in hand will tend to warm quickly from the heat exhibited by body temperature. For obvious reasons, cups have been created with a double paper layer to provide insulation in the form of a protective insulating sleeve or a double-walled cup. Both provide an increased thickness at the hand-held region of the cup. Some of the best insulating constructions for paper cups provide for the double layers to be spaced apart so that air is located between two layers of paper. There is a need for a beverage container with improved insulating properties to maintain the temperature of the beverage that is also easy to manufacture and attractive to the consumer. The present invention provides such an improved insulating cup.

SUMMARY OF THE INVENTION

According to one aspect of the invention, an insulating cup is provided. The insulating cup includes an inner body and an outer body. The inner body includes an inner sidewall defining a top opening and a bottom portion. The outer body includes an outer sidewall surrounding at least a portion of the inner sidewall. The outer sidewall folds inwardly and upwardly at the bottom end to form a distal fold that effectively spaces the inner surface of the outer sidewall at the bottom end away from the outer surface of the inner sidewall. The outer sidewall further includes an embossment across the majority of the length and width of the sidewall such that the inner surface of the outer sidewall projects inwardly towards the inner body to effectively space apart the inner surface of the outer sidewall from the outer surface of the inner body. The distal fold effectively separates the inner sidewall and the outer sidewall creating an insulating air space between the entire embossment region and the inner sidewall.

According to another aspect of the invention, an insulating cup is provided. The insulating cup includes an inner body having an inner sidewall defining a top opening, and a bottom portion. The inner sidewall has an inner surface and an outer surface and defines a surface-engaging bottom edge. The insulating cup includes an outer body having an outer sidewall. The outer sidewall has an inner surface and an outer surface defining a thickness therebetween. The outer sidewall has a proximal end and a distal end interconnected by two sides. The outer sidewall surrounds at least a substantial portion of the inner sidewall such that the proximal end is near the top opening and the distal end is near the bottom edge and the inner surface of the outer body faces the outer surface of the inner body. The distal end includes a circumferential distal fold. The distal fold spaces the inner surface of the outer body from the outer surface of the inner body by a distance. The outer sidewall has an embossment on a substantial portion of the outer sidewall. The embossment has an inner surface and an outer surface.

An insulating cup includes an inner body and an outer body. The inner body includes an inner sidewall defining a top opening and a bottom portion. The outer body includes an outer sidewall surrounding at least a portion of the inner sidewall. The outer sidewall folds inwardly and upwardly at the bottom end to form a distal fold that spaces the inner surface of the outer sidewall at the bottom end away from the outer surface of the inner sidewall. The outer sidewall further includes an embossment across the majority of the length and width of the sidewall such that the inner surface of the outer sidewall projects outwardly away from the inner body to effectively space apart the inner surface of the outer sidewall from the outer surface of the inner body in the location of the embossment. The distal fold and embossment effectively separates the inner sidewall and the outer sidewall creating an insulating air space between substantially the entire inner surface of the outer sidewall and the outer surface of the inner sidewall except at the distal fold, at a margin at the proximal end and at margins at the sides of the outer sidewall.

DETAILED DESCRIPTION OF THE INVENTION

Turning now to the figures, there is shown an insulating cup 10 having a longitudinal axis according to the present invention. The insulating cup 10 includes an inner body 12 connected to an outer body 14. The inner body 12 forms a cup container and the outer body 14 forms a sleeve-like structure that encompasses and surrounds at least a portion of the cup in the location where a user would grasp and hold the cup 10. The outer body 14 serves to protect the user from hot beverages contained in the cup as well as to help insulate hot or cold beverages contained in the cup 10. The inner body 12 and the outer body 14 will now be described in greater detail.

Figure 1:
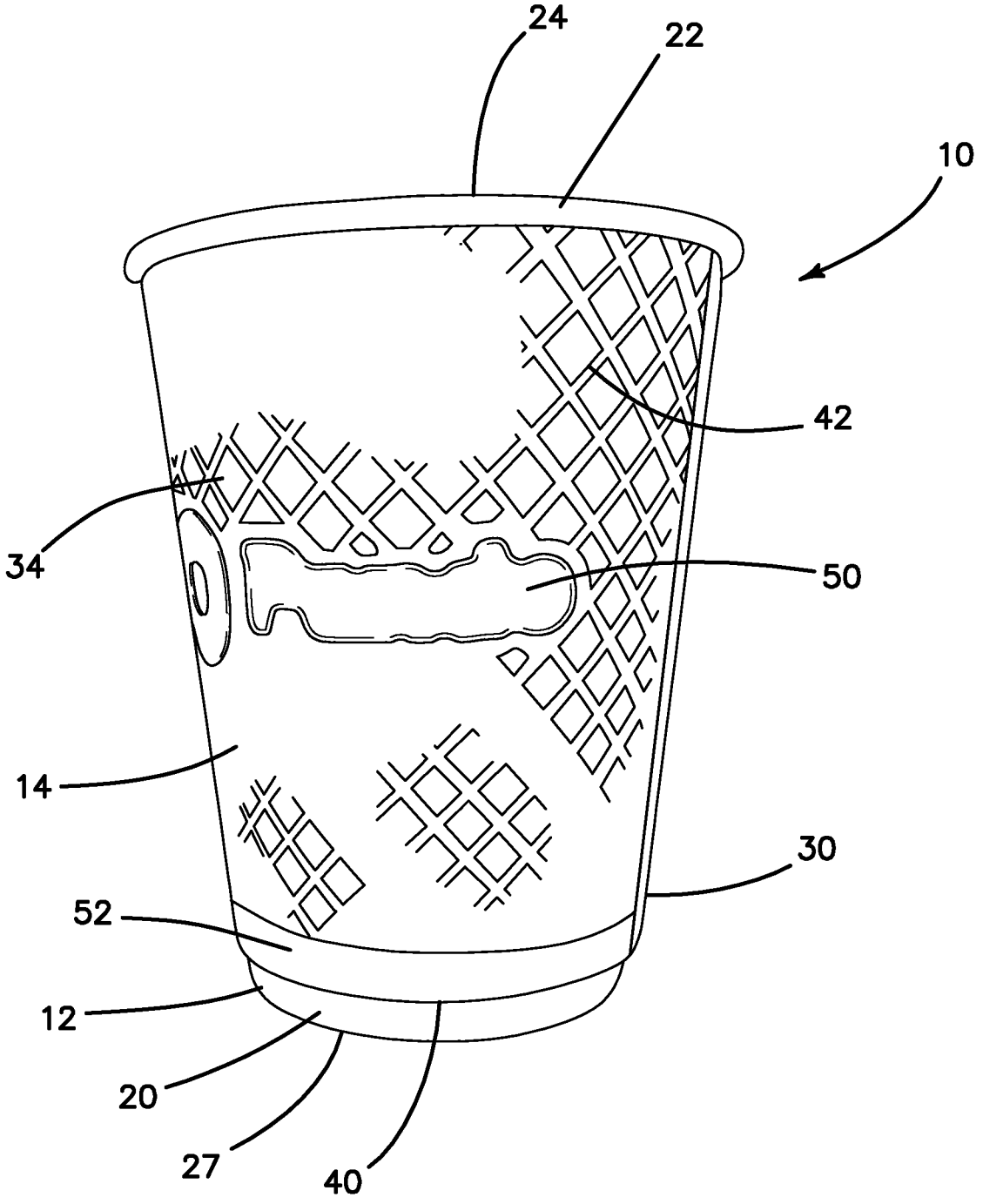
FIG. 1 is a front view of an insulating cup according to the present invention.
Figure 2:
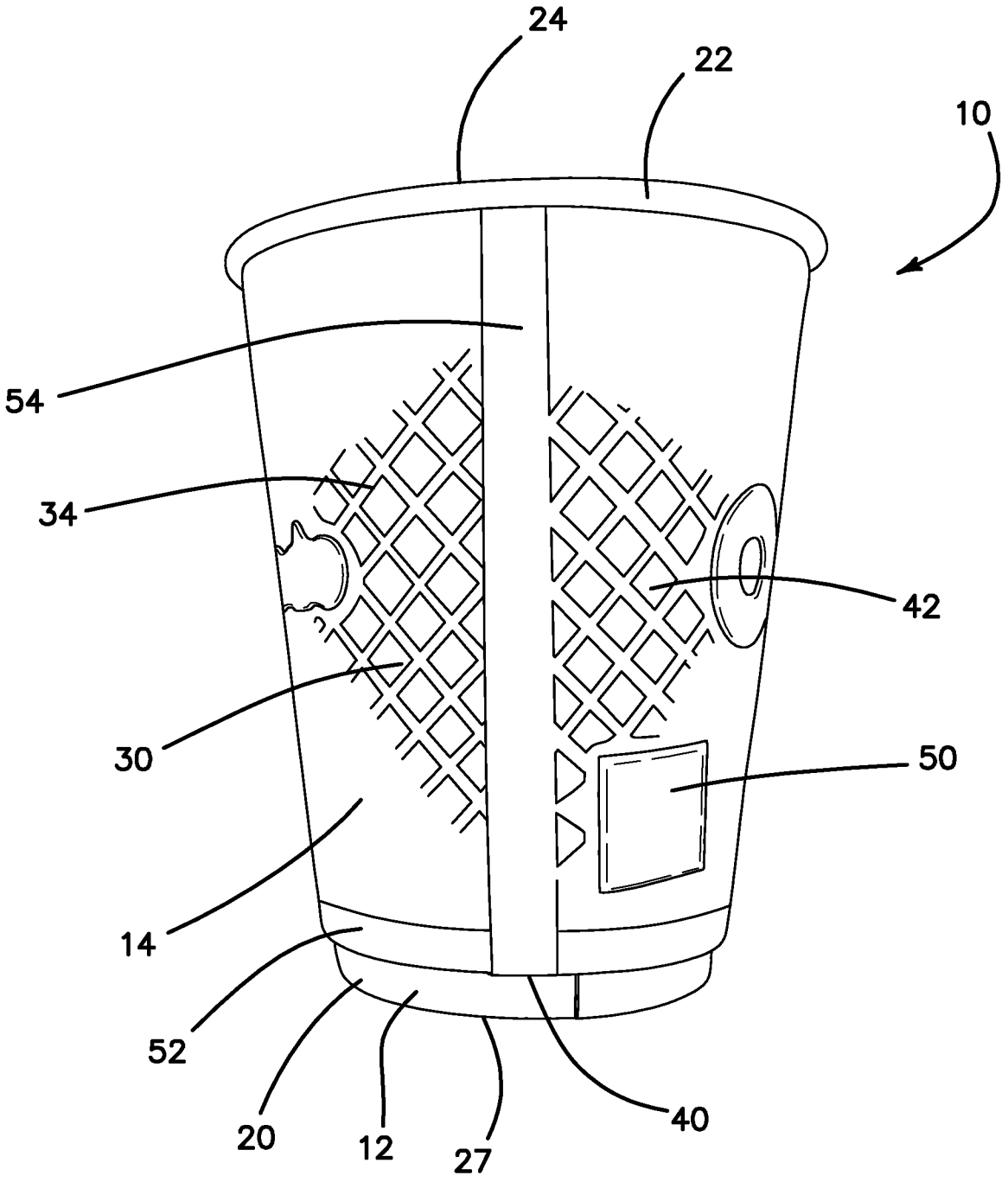
FIG. 2 is a side view of an insulating cup according to the present invention.
Figure 3A:
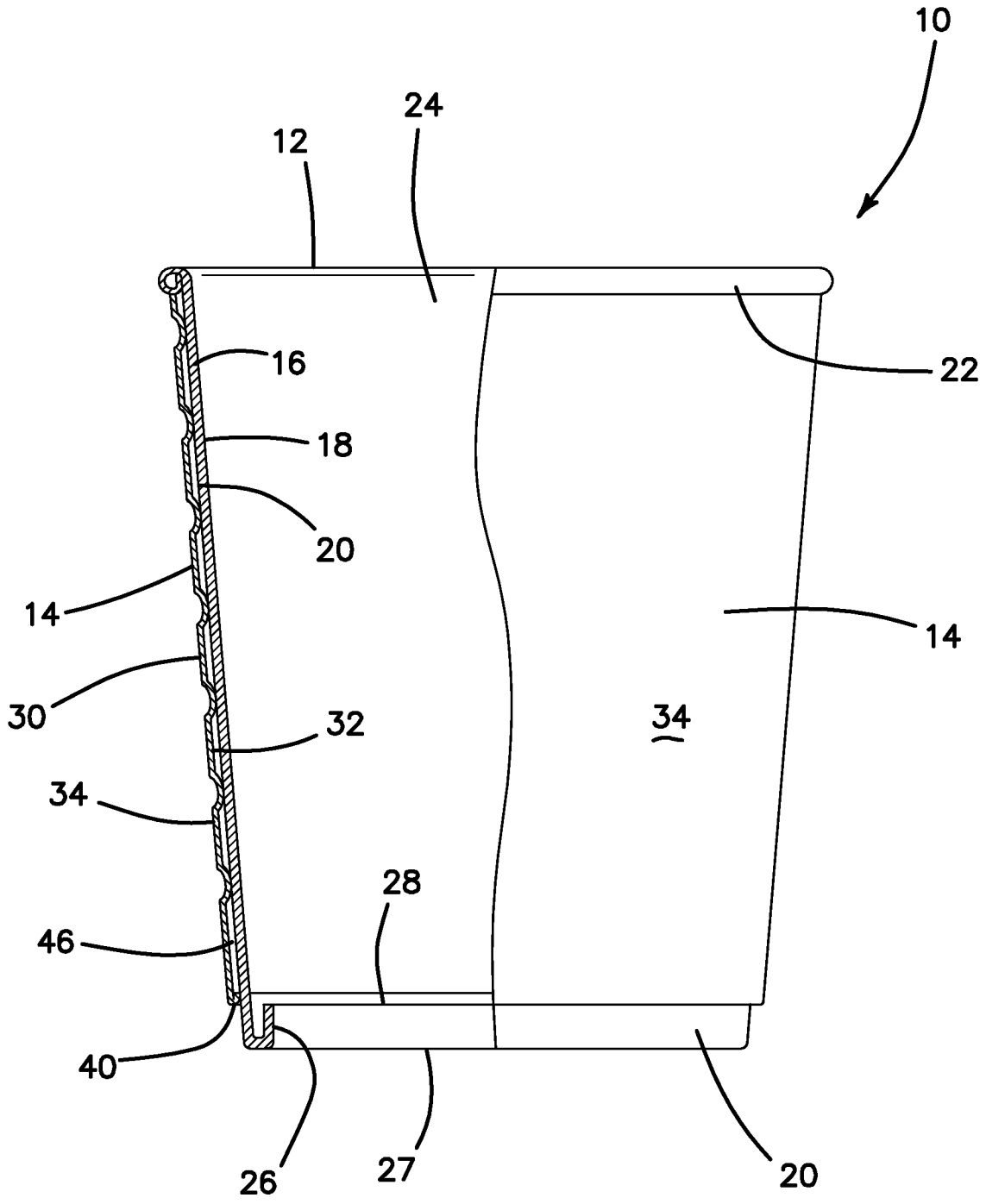
FIG. 3A is a partial cross-sectional view of an insulating cup according to the present invention.
Figure 3B:
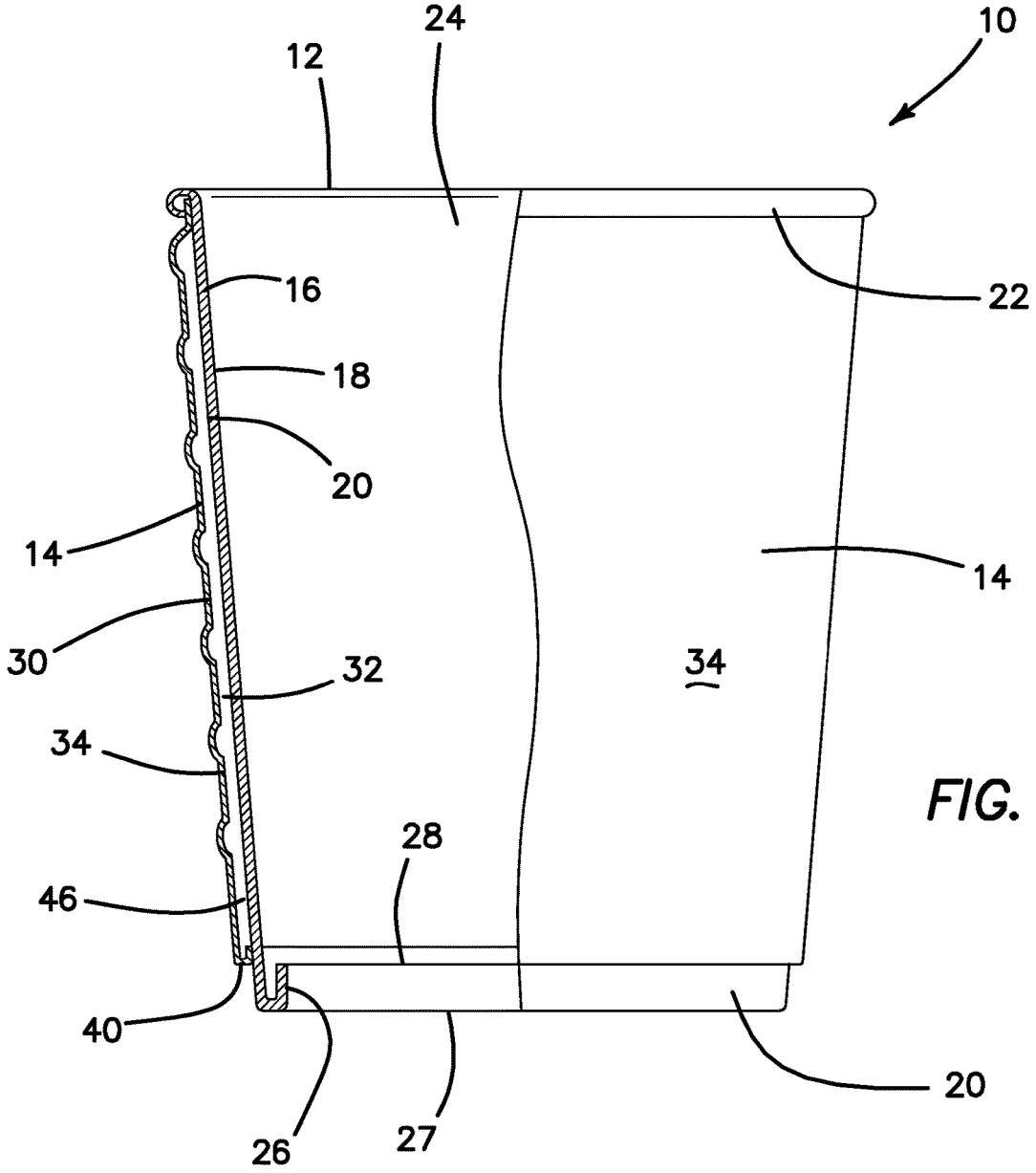
FIG. 3B is a partial cross-sectional view of an insulating cup according to the present invention
Figure 3C:
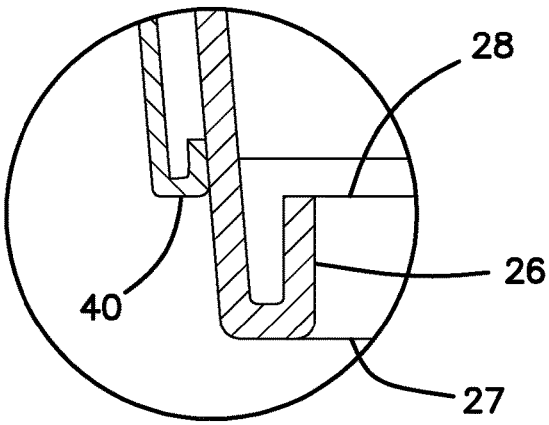
FIG. 3C is a section view of FIG. 3B of an insulating cup according to the present invention
Figure 4:
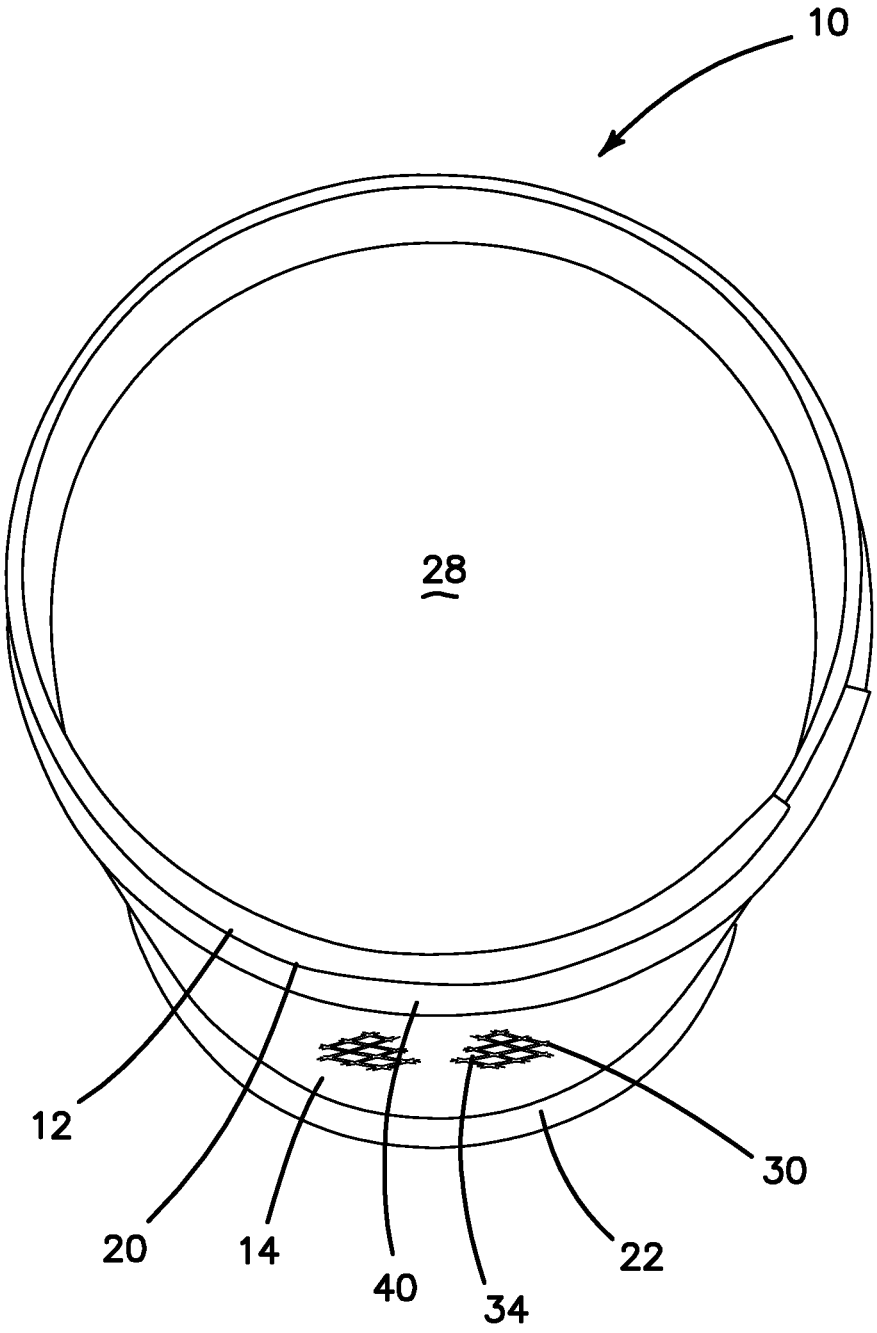
FIG. 4 is a bottom perspective view of an insulating cup according to the present invention.
Figure 5:
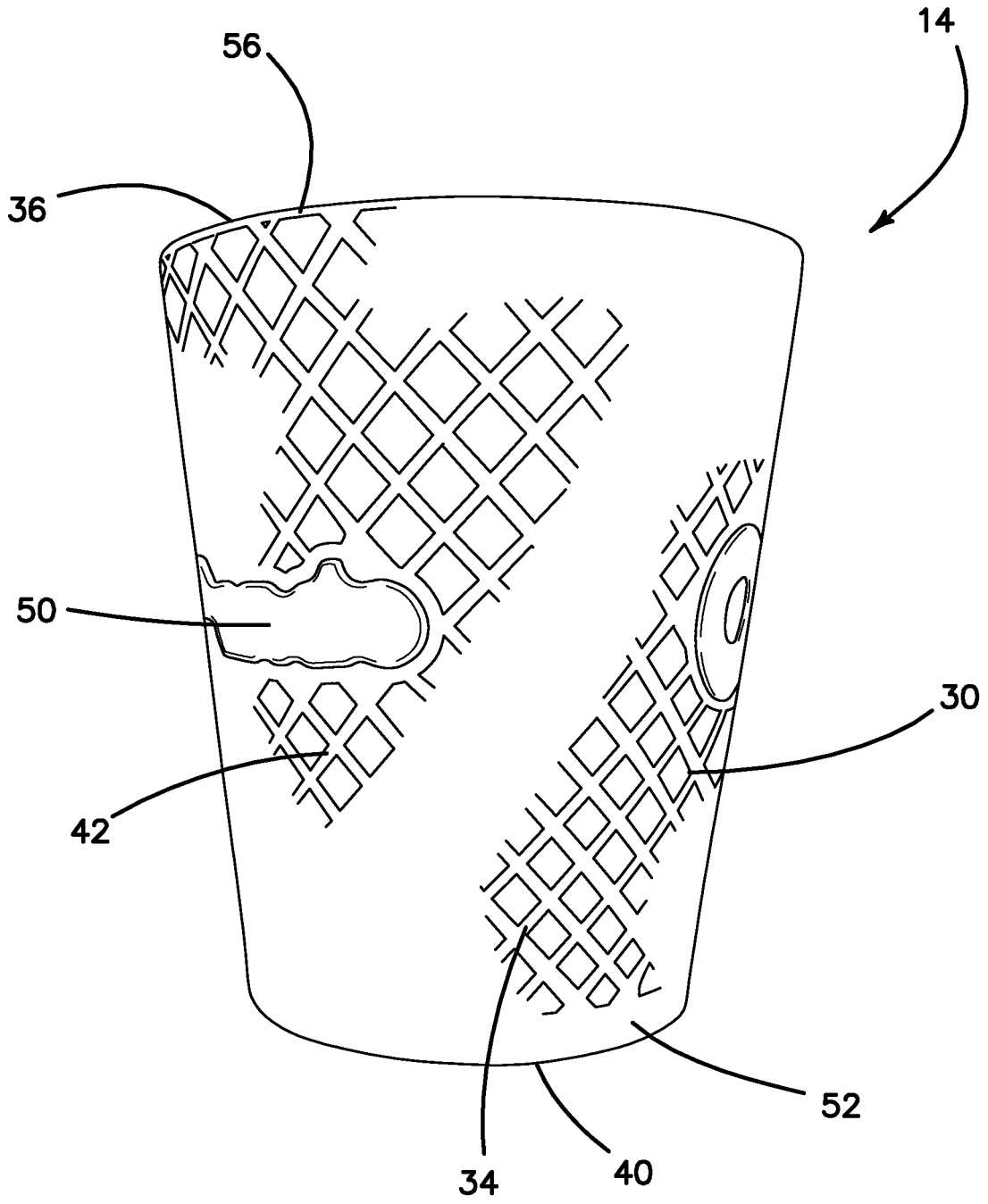
FIG. 5 is a side view of an outer body of an insulating cup according to the present invention.

The inner body 12 includes an inner sidewall 16 having an inner surface 18 and an outer surface 20 defining a thickness therebetween. The inner sidewall 16 defines a top opening 24 at the top end of the inner sidewall 16. The top end of the inner sidewall 16 may curl outwardly away from the longitudinal axis to define a smooth, curved circumferential lip or rim 22. The curved rim 22 forms a smooth surface for comfortable contact with the users mouth/lips. The bottom end of the inner sidewall 16 is folded inwardly toward the longitudinal axis of the cup and upwardly to form an inwardly and upwardly folded segment 26 defining a bottom edge 27 of the cup. The bottom edge 27 of the cup supports the cup on a table top or other surface and the inwardly/upwardly folded segment 26 is configured to receive in the fold a portion of a base 28. In another variation, the inner body 12 is formed without an inwardly folded segment 26 and the bottom edge 27 is coincident or substantially coincident with the bottom end of the inner sidewall 16. The inner body 12 further includes a base 28 that defines a bottom wall of the cup. The base 28 is made of a separate sheet of material and is connected to the inner sidewall 16. In one variation, a circumferential portion of the base 28 folds downwardly and is received and secured with adhesive within the inwardly and upwardly folded segment 26 as shown in FIG. 3. In another variation, the base 28 is formed integrally with the inner sidewall 16. The inner sidewall 16 and the base 28 define the inner volume of the cup 10.

The inner body 12 is made from a single sheet of material. When the sheet of material is laid flat, it has a generally convex top end and a concave bottom end interconnected by two sides that are angled away with respect to each other from the bottom end. The flat sheet is rolled/curled such that the two angled sides overlap each other and are adhered to define the inner circumference having an inner diameter of the inner body 12 and outer periphery having an outer diameter of the inner body 12. The top end is formed with the curled lip 22 and the bottom end is configured with the inwardly folded segment 26 and connected to the base 28. The inner body 12 has a typical frustoconical shape such that the inner sidewall 16 angles slightly outwardly to define a larger diameter at the top opening 24 relative to the diameter at the base 28; however, the shape of the inner body 12 is not so limited and can have any suitable shape such as cylindrical, rectangular, cone or other suitable geometric shape. The cup is made of any suitable material such as paper, cardstock, plastic, polymer and the like, and preferably, but not limited to, disposable and recycled/recyclable material.

The outer body 14 will now be described. The outer body 14 is also called a sleeve. The outer body 14 includes an outer sidewall 30 having an inner surface 32 and an outer surface 34 defining a thickness therebetween. The outer sidewall 30 is configured from a single sheet of material having a convex top end and a concave bottom end interconnected by two sides that angled with respect to each other when the sheet of material is laid flat. The sheet is rolled/curled so that the two angled sides overlap each other and are adhered to define the outer sidewall 30. The outer sidewall 30 has a central lumen and defines an inner diameter at the inner surface 32 and an outer diameter at the outer surface 34. The outer body 14 has a top opening 36 at the top end and a bottom opening 38 at the bottom end. The outer body 14 has a frustoconical shape that substantially matches the frustoconical shape of the inner body 12 except that the inner diameter of the outer body 30 is equal to or greater than the outer diameter of the inner body 12 to form an outer sleeve that surrounds the inner body 12. To complete the cup, the bottom end of the inner body 12 is inserted into the top opening 36 of the outer body 14 and moved into the lumen of the outer body 30 until the inner surface 32 of the outer body 30 frictionally engages the outer surface 20 of the inner body 12 sufficiently to create a friction-fit engagement. Adhesive 44 may be provided between the inner body 12 and the outer body 14 to secure the two together. Alternatively, the outer body 14 is wrapped around the inner body 12 and the two sides of the outer body 14 overlapped and adhered with adhesive. Additional adhesive 44 may be applied between the inner surface 32 of the outer body 14 and the outer surface 20 of the inner body 12. The outer body 14 is located along the length of the inner body 12, preferably along at least a portion of the length of the inner body 12 between the top end and bottom end of the inner body 12. In one variation, the top end of the outer body 14 is located at, in contact with, or just distal to the lip 22 or top end of the inner body 12. The bottom end of the outer body 14 is located at, or in contact with, or just proximal to the bottom edge 27. In general, the outer body 30 defines the outer sidewall 30 and a second wall of the container with the first wall being the inner body 12.

Figure 8:
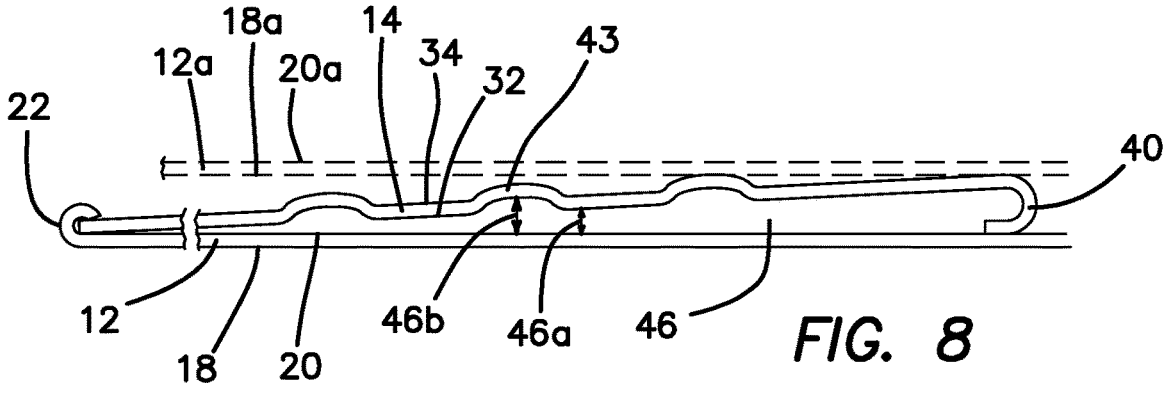
FIG. 8 is a partial cross-sectional view of an insulating cup and an adjacent stacked inner body of another insulating cup according to the present invention.

The outer body 14 further includes a distal fold 40 or distal rise 51. The bottom end of the outer sidewall 30 is folded inwardly towards the longitudinal axis and upwardly to form the distal fold 40. The distal fold 40 extends around the bottom circumference of the outer body 14. When the outer body 14 is connected to the inner body 12, a portion of the outer surface 34 of the outer sidewall 30 is in contact with the outer surface 20 of the inner body 12. Due to the distal fold 40, the thickness of the outer body 14 at the location of the distal fold 14 is twice the thickness of the outer sidewall 30. For example, if the thickness of the outer sidewall 30 is "x" as measured between the inner surface 32 and outer surface 34, the thickness of the outer body 14 at the location of the distal fold 40 is approximately 2x, at least approximately 2x, or at least approximately 3x depending on the type of fold made. In general, the fold 40 increases the thickness of the outer body 14 to be greater than the thickness between the inner and outer surfaces 32, 34 of the outer body 14. As can be seen in FIGS. 3 and 8, the distal fold 40 serves to create a space 46 between the inner surface 32 of the outer sidewall 30 and the outer surface 20 of the inner sidewall 16 by a distance of approximately "x", the thickness as measured between the inner surface 32 and the outer surface 34 of the outer sidewall 30. The distal fold 40 spaces apart the outer body 14 from the inner body 12.

The outer body 14 further includes a relief pattern/embossment 42. The relief pattern 42 includes a plurality of projections that extend outwardly away from the cup. In the location of these projections, a plurality of depressions is formed with respect to the inner surface of the outer body 14. The depressions are in the same location as the projections just on the other side creating the relief pattern. The projections and their corresponding and oppositely disposed depressions are shown in the figures to have a diamond-like shape; however, the invention is not so limited and the projections/depressions may be circular, oval, square, rectangular, polygonal, star shaped or have any shape or amorphous pattern or curvature. The projections are interspaced by non-relief portions of the outer sidewall 30. These non-relief portions may also have a shape and size that corresponds to the shape and size of the projections. In the figures, the non-relief portions of the outer sidewall 30 are a plurality of angled, rectangular strips that intersects with a plurality of oppositely angled non-relief rectangular strips to create the diamond-shaped, relief windows between their intersections. In one variation, the non-relief portions form contact points at the inner surface of the outer sidewall 30 that contact the outer surface of the inner sidewall 16 as shown in FIG. 3A. From the perspective of the inner surface 32, the depressions form insulating air pockets while the non-relief portions form contact points that also advantageously serve as support points that withstand crushing of the air pockets when the cup is grasped. In another variation, the relief pattern 42 creates a plurality of raised locations 43 on one of the inner and outer surface of the outer sidewall 30 forming undulations above and below a center line. These raised locations are spaced apart by depressed locations having the same or different pattern, size and shape. In another variation, the raised locations on one of the inner and outer surface of the outer sidewall 30 form a plurality of complementarily depressed locations on the other one of the inner and outer surface of the outer sidewall. As shown in FIG. 3B, the raised locations are visible at the outer surface of the outer sidewall and depressed locations are visible in corresponding locations from the perspective of the inner surface of the outer sidewall. As previously mentioned, a space 46 is created between the inner surface 32 of the outer sidewall 30 and the outer surface 20 of the inner sidewall 16. This space 46 is not constant as can be seen in FIG. 8 but varies along the longitudinal length of the cup 10. The distance or space 46 between the inner surface 32 and the outer surface 20 is greatest at a location proximal to the distal fold 40 or rise 51 and then decreases gradually to a location proximal to the proximal end or lip 22 of the cup 10 where there is no space as the inner surface 32 contacts the outer surface 20. Hence, the outer sidewall 30 is progressively and circumferentially ramped/angled with respect to the inner sidewall 16. In one variation, the inner surface 32 does not contact the outer surface 20 between the entire length between the proximal end at the lip and the distal end at the fold and defines a space 46*a* with respect to a center line of the outer sidewall 30 and further defines a space 46*b* with respect to the raised location of the embossments. The embossment 50 advantageously increases the insulation capacity at space 46*b* throughout the cup relative to another cup that without embossment which would be limited to the insulative capacity at a space 46*a* at any given location around the cup. If a cup with embossment according to the present invention is grasped by a user, the space 46*a* may be decreased by force of the user's grasp, but the insulative capacity would be preserved since the space 46*b* at the embossment would not be readily reduced by the grasp.

The embossment raises the outer sidewall to provide depth to the design/logo/relief pattern. A flat piece of material of the outer sidewall is pressed into a female die that has a design engraved or etched into it. The pressing is typically accomplished with a male counterpart die underneath so that the sidewall is sandwiched between the two and the design is transferred to the sidewall. Embossing may refer to a raised surface or used to create a depressed design or debossment in the sidewall. The sidewall may be pressed in a roll press, stamp press, clamshell press or the like. In one variation, when the cup is assembled, the embossment at the inner surface of the outer sidewall does not contact the outer surface of the inner sidewall in a resting configuration as shown in FIGS. 3B and 8. In another variation, the embossment at the inner surface of the outer sidewall contacts the outer surface of the inner sidewall in a resting configuration as shown in FIG. 3A. When a user grabs the cup in use, in a second configuration, or non-resting configuration, the embossment at the inner surface of the outer sidewall may contact the outer surface of the inner sidewall at the points of contact with the user's fingers/hand deflecting the outer sidewall inwardly toward the inner sidewall while maintaining an insulative distance between the inner surface of the outer sidewall and the outer surface of the inner sidewall at other parts of the embossment.

The relief pattern 42 is an embossment of the outer sidewall in a pattern across the majority of the length and width of the outer body. The plurality of projections/prominences from the plane of the outer sidewall and corresponding depressions on the other side of the outer sidewall form a decorative pattern or surface design while advantageously spacing apart the outer body from the inner body, in particular, spacing apart the inner surface of the outer body from the outer surface of the inner body to create an insulating air space/air pockets 46 that effectively protects the user and helps maintain the beverage temperature. In one variation, the outer sidewall 30 is printed with a shape, such as a circle, shape, polygon, logo or other shape randomly throughout the outer sidewall 30 in a uniform pattern across at least part of the outer sidewall 30. Particularly, when a user grasps the cup and holds the cup, the points of contact due to the embossment together with the increased rigidity at the distal end provided by the distal fold 40 substantially prevent the air space/air pockets 46 from being completely collapsed while providing a primary cushion by air space 46*a* that is reducible, thereby, maintaining the cup's improved insulating capacity and performance. Various ornamental relief patterns are within the scope of the present invention and may include one or more of various shapes such as logos 50 or advertising portions or areas to receive advertising portions and logos 50 on the outer body. The embossment is created when a regular sheet of material as described above is imprinted, pressed, molded, stamped, rolled against and/or between one or more plate and/or cylinder and forced thereagainst with pressure and the application of heat if necessary to mold the plurality of protuberances and indentations on the outer body. The embossment process will reduce the length and width of the sheet of material. Therefore, the size of the sheet of material is selected to match the size of the cup that the outer body is configured encompass after the embossment is printed.

As can be seen in the figures, the embossment 42 is provided across the majority of the length and width of the outer body 14. In the figures, embossment is shown 42 illustratively and conservatively along the outer body 14 and is not intended to be limiting as to the location, amount or style of embossment. In particular, the outer body 14 does not have any embossment 42 along a margin 52 at the bottom end where the distal fold 40 is formed. Also, the outer body 14 advantageously does not have any embossment 42 along a margin 54 at either of the sides of the outer sidewall 30 where the sides overlap and are adhered to each other to form the central lumen. The presence of embossment 42 at the sides of the outer sidewall would be interfere with the adherence of the sides as the sides need to be pressed together for adherence and such pressure would squash the embossment 42 making for an unpleasant appearance. Also, there is no embossment 42 along a margin 52 at the bottom end because the presence of embossment 42 along the bottom end would interfere with the formation of the distal fold 40 where the embossment 42 would be squashed or deformed and prevent formation of a clean aesthetic distal fold 40. Hence, there is no embossment 42 in these locations and embossment 42 is provided substantially everywhere else on the outer body 14. Also, a small margin 56 without embossment is provided near the top end so that a small portion of the outer sidewall 30 can be discretely tucked under the curled lip 22 at the proximal end of the inner body 12 to help secure the outer body 14 to the inner body 12 and advantageously create the appearance of a smooth transition between the inner and outer bodies as well as an integrated appearance of the embossment pattern. The embossment provides the user with a tactile sensation along the pattern or logo which creates a pleasant sensation that encourages the user to comfortably hold and rub the cup and because the technology provides for an exceptionally insulated point of contact the cup provides for an enjoyable drinking experience.

In use, a plurality of cups is usually stored in a stacked fashion for customer use. In particular, the bottom of one cup is inserted into the top opening 24 of an adjacent cup and so on. In order to be capable of stacking, the cups have the same frustoconical shape. Therefore, they tend to interlock due to friction of the inside of one cup against the outside of the adjacent cup forcing the user to use both hands and touch the rim portion to remove a cup from the stack. The present invention advantageously facilitates removal of adjacent cups from a stack of cups and prevents adjacent cups sticking together in the stack because the distal fold 40 displaces the distal end of the outer body 14 outwardly creating an outer angle that is dissimilar from the inner angle of the inside surface 18*a* of the adjacent cup 12*a* effectively reducing the surface area in contact and, thereby, reducing the friction between stacked cups as shown in FIG. 8. The friction between stacked cups is advantageously reduced to surface contact points at the distal fold 40 and raised portions 43 of the embossment near the distal end instead of along a greater length of the cup surfaces. In one variation, the distal fold 40 is formed without adhesive for keeping the distal fold 40 in place. Therefore, without adhesive, the distal fold 40 has a tendency to unfold and spring towards its unfolded state. This bias action further facilitates the maintenance of the insulating air space even while the cup is grasped by the user or held in a cup holder. In another variation, the distal fold 40 is provided with adhesive. In another variation, adhesive is employed to maintain the distal fold 40.

Figure 6:
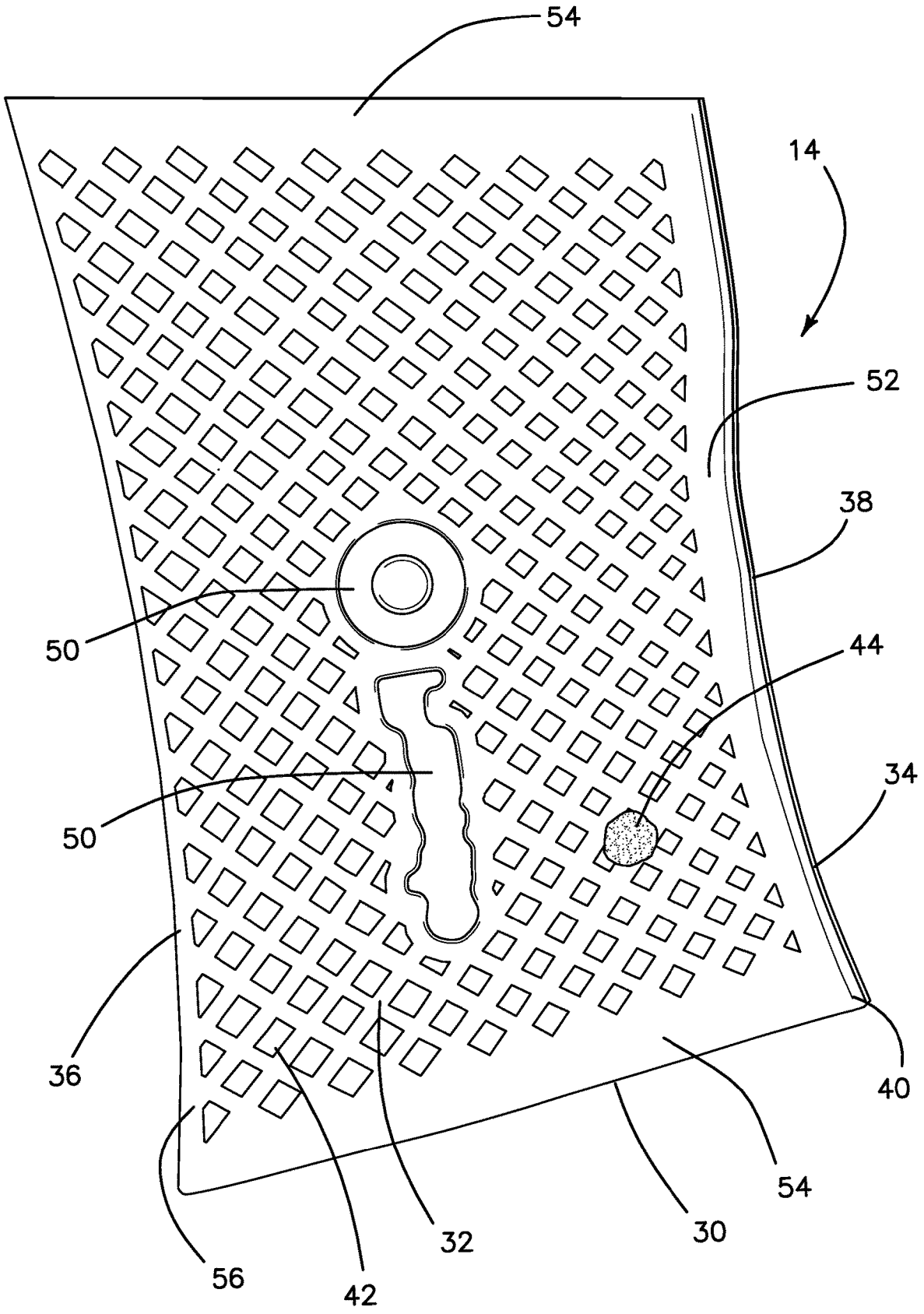
FIG. 6 is a top perspective, view of an inner surface of an outer body of an insulating cup according to the present invention.
Figure 7:
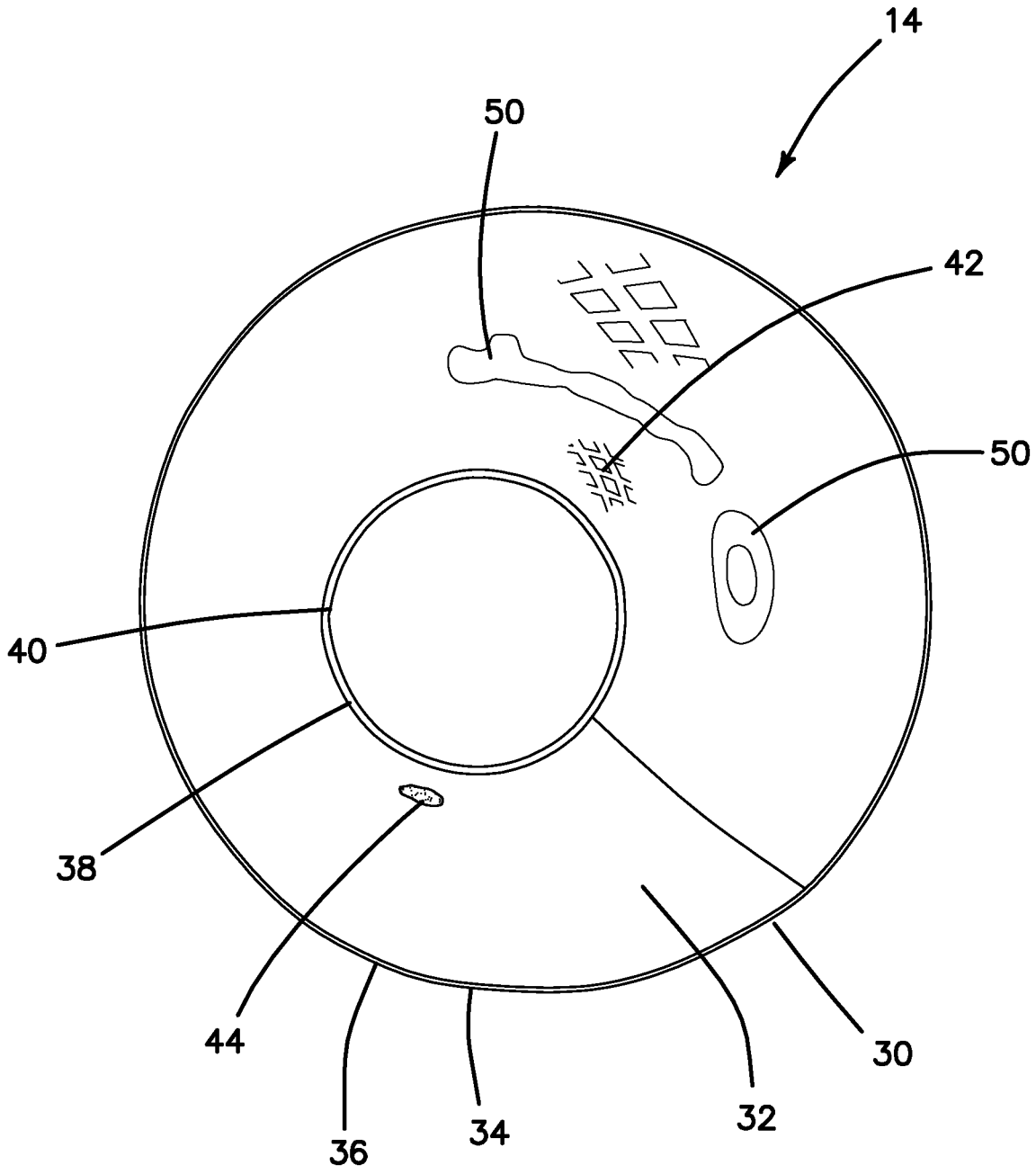
FIG. 7 is a top perspective view of an outer body of an insulating cup according to the present invention.

In one method of manufacturing the cup 10, a sheet of material for the outer body 14 is provided and cut to specification to form the outer sidewall. The outer sidewall is then embossed with a relief pattern reducing its overall dimensions. The outer sidewall is curled so that the sides are overlapped and glued together with adhesive along the side margin 54 to form the outer body 14 having a central lumen. The distal end of the outer body 14 is folded to form a circumferential, peripheral distal fold 40. The distal fold 40 is approximately 1-5 millimeters long. The inner body 12 is inserted into the central lumen of the outer body 14. The top end of the outer body 14 is tucked slightly under the lip 22 at the top end of the inner body in one variation. Adhesive is provided between the inner body 12 and the outer body 14 to adhere the two together to form the insulating cup 10. The adhesive 44 may be a small dot in one or more locations as shown in FIG. 6 and/or the adhesive 44 may be a line of adhesive that is applied in a curved or in a straight line fashion such as along the top, along a latitudinal circumference, or along a longitudinal line. In use, the cup 10 is grasped by the user at a location along the outer body 14. The force of the grasp will have a force component in the radial direction inwardly toward the longitudinal axis of the cup. This force will be opposed by an opposite radial force provided by the cantilevered distal fold as well as by the embossment around the cup also having a radial component to maintain the insulating space 46 between outer body 14 and the inner body 12. In the event the insulating space 46 is reduced, the distal fold 40 and the substantially uniform and continuous embossment will tend to advantageously bias any reduced space 46 towards an enlarged, normal or less-reduced space 46 advantageously maintaining the insulating function of the cup 10.

Figure 9A:
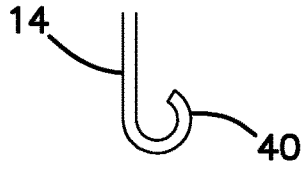
FIG. 9A is a cross-sectional view of a distal end of an outer body of an insulating cup according to the present invention.
Figure 9B:
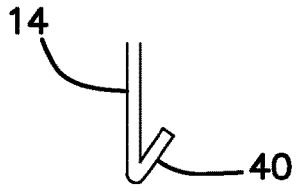
FIG. 9B is a cross-sectional view of a distal end of an outer body of an insulating cup according to the present invention.
Figure 9C:
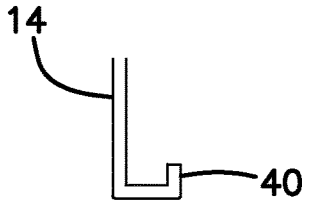
FIG. 9C is a cross-sectional view of a distal end of an outer body of an insulating cup according to the present invention.
Figure 9D:
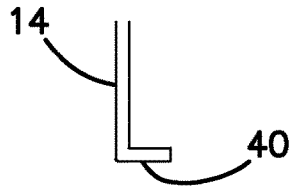
FIG. 9D is a cross-sectional view of a distal end of an outer body of an insulating cup according to the present invention.
Figure 9E:
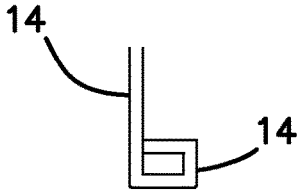
FIG. 9E is a cross-sectional view of a distal end of an outer body of an insulating cup according to the present invention.
Figure 9F:
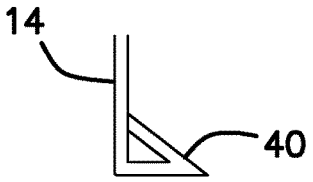
FIG. 9F is a cross-sectional view of a distal end of an outer body of an insulating cup according to the present invention.
Figure 9G:
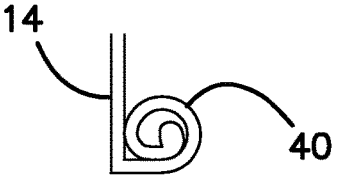
FIG. 9G is a cross-sectional view of a distal end of an outer body of an insulating cup according to the present invention.
Figure 10A:
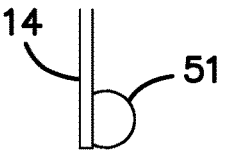
FIG. 10A is a cross-sectional view of a distal end of an outer body of an insulating cup according to the present invention.
Figure 10B:
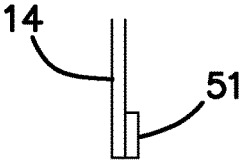
FIG. 10B is a cross-sectional view of a distal end of an outer body of an insulating cup according to the present invention.

With reference to FIGS. 9A-9F, the distal fold 40 may be curled into a substantially U-shaped fold as shown in FIG. 9A. The distal fold 40 may have an acute angle forming a substantially V-shaped fold as shown in FIG. 9B. The distal fold 40 may have a substantially L-shaped formation as in FIGS. 9C and 9D. The distal fold 40 may have a polygonal shape such as a square or rectangle shown in FIG. 9E or triangle in FIG. 9F. The distal fold 40 may also have a spiral shape as shown in FIG. 9G. FIGS. 10A-10B, illustrate variations wherein a rise or spacer 51 is provided at the distal end instead of folding the distal end to achieve the same function. In FIG. 10A, the rise/spacer 51 in the outer body 14 is a bead of material such as adhesive that is attached to the distal end. In FIG. 10B, the rise/spacer 51 is formed by attaching another layer of paper or other suitable material to the distal end. The illustrations in FIGS. 9-10 are intended to be illustrative and are not intended to be limiting. Also, the shape of the cup is not limited to a circular bottom and a circular top opening but may include cups having a circular bottom and a polygonal, square or rectangular top opening and vice versa.

It is understood that various modifications may be made to the embodiments of the insulating cup disclosed herein. Therefore, the above description should not be construed as limiting, but merely as exemplifications of preferred embodiments. Those skilled in the art will envision other modifications within the scope and spirit of the present disclosure.

I claim:

1. An insulating cup comprising:

a straight inner body including an inner sidewall defining a top opening, and a bottom portion; the inner sidewall having an inner surface and an outer surface and defining a surface-engaging bottom edge; wherein the inner body has an outwardly rolled top portion defining a circumferential curled rim around the top opening; and an angled outer body including an outer sidewall; the outer sidewall having an inner surface and an outer surface defining a thickness therebetween; the outer sidewall having a proximal end and a distal end interconnected by two sides; the outer sidewall surrounding at least a substantial portion of the inner sidewall such that the proximal end of the outer sidewall is tucked under the curled rim and the distal end is near the bottom edge; the inner surface of the outer sidewall faces the outer surface of the inner sidewall; the distal end including at least one circumferential distal fold; wherein the outer sidewall tapers outwardly from the proximal end to the distal fold; the distal fold spacing apart the inner surface of the outer sidewall and the outer surface of the inner sidewall; the outer sidewall having a plurality of embossments on a substantial portion of the outer sidewall protruding outwardly of the outer sidewall and away from the inner sidewall; the embossments having an inner surface and an outer surface; wherein distance between the inner surface of each embossment and the outer surface of the inner sidewall increases along the outer sidewall from the proximal end to the distal fold; wherein a hollow space is formed between the inner sidewall and the outer sidewall from the proximal end to the distal fold.

2. The insulating cup of claim 1 wherein the distal fold is proximal to the surface-engaging bottom edge.

3. The insulating cup of claim 1 wherein the distal end is inwardly folded toward a longitudinal axis of the cup to form the distal fold.

4. The insulating cup of claim 1 wherein the bottom wall is a separate member having a peripheral flange.

5. The insulating cup of claim 1 wherein the inner sidewall is folded inwardly and upwardly at the distal end to define the surface-engaging bottom edge.

6. The insulating cup of claim 1 wherein the embossments are located circumferentially around the outer sidewall except at a margin defined along each of the two sides.

7. The insulating cup of claim 1 wherein a distance from the outer surface of the inner sidewall to the outer surface of the outer sidewall is at least twice the thickness of the outer sidewall at the distal fold.

8. The insulating cup of claim 1 wherein the embossments include raised portions with respect to the outer surface of the outer sidewall; the raised portions having conforming depressed locations with respect to the inner surface of the outer sidewall.

9. The insulating cup of claim 1 wherein when stacked the inner surface of an adjacent cup having an identical inner body contacts the outer surface of the outer sidewall in the location of distal fold and the raised portions of the embossment.

10. The insulating cup of claim 1 wherein the distal fold is curved.

11. The insulating cup of claim 1 wherein the outer sidewall includes a proximal margin without embossment circumferentially around the proximal end, a distal margin without embossment circumferentially around the distal end, a first margin without embossment at one of the two sides and a second side margin without embossment at the other one of the two sides; and wherein the inner surface of the outer sidewall at the proximal margin and the inner surface of the outer sidewall at one of the first margin and second margin and the distal fold contacts the outer surface of the inner sidewall.

12. An insulating cup, comprising:

a straight inner body; the inner body including an inner sidewall defining a top opening and a bottom portion; the inner sidewall having an inner surface and an outer surface and defining a surface-engaging bottom edge; wherein the inner body has an outwardly rolled top portion defining a circumferential curled rim around the top opening; and an angled outer body; the outer body including an outer sidewall surrounding at least a portion of the inner sidewall; the outer sidewall having an inner surface and an outer surface; the outer sidewall having a proximal end and a distal end interconnected by two sides; the proximal end of the outer sidewall being tucked under the curled rim; the outer sidewall folding inwardly at the distal end to form a distal fold that spaces the inner surface of the outer sidewall at the distal end away from the outer surface of the inner sidewall; the outer sidewall tapering outwards from the proximal end to the distal fold; the outer sidewall further including a plurality of embossments across a majority of the length and width of the sidewall; the embossments protruding outwardly such that a distance between the inner surface of the embossments and the outer surface of inner sidewall increases along the outer sidewall from the proximal end to the distal fold to form a hallow space between the inner sidewall and outer sidewall from the proximal end to the distal fold;

wherein the outer sidewall includes a proximal margin without embossment circumferentially around the proximal end, a distal margin without embossment circumferentially around the distal end, a first side margin without embossment at one of the two sides from the proximal end to the distal end and a second side margin without embossment at the other one of the two sides from the proximal end to the distal end.

13. The insulating cup of claim 12 wherein the first side margin and second side margin overlap and are connected with adhesive.

14. The insulating cup of claim 12 wherein the inner surface of the outer sidewall at the proximal margin and the inner surface of the outer sidewall at one of the first margin and second margin and the distal fold contact the outer surface of the inner sidewall.

15. The insulating cup of claim 12 wherein the entire inner surface of the outer body is spaced apart from the outer surface of the inner body.

16. The insulating cup of claim 12 wherein the outer sidewall is folded inwardly and upwardly at the distal end to form a distal fold.

17. The insulating cup of claim 12 wherein the distance between the inner surface of the outer sidewall and the inner sidewall creates an insulating air space between the entire inner surface of the outer sidewall and the outer surface of the inner sidewall from the proximal end to the distal fold.

* * * * *